US010001147B2

(12) United States Patent
Kleitsch

(10) Patent No.: US 10,001,147 B2
(45) Date of Patent: Jun. 19, 2018

(54) INDEPENDENT METERING VALVE PRIORITY IN OPEN CENTER HYDRAULIC SYSTEM

(71) Applicant: Caterpillar Inc., Peoria, IL (US)

(72) Inventor: Andrew J. Kleitsch, Shorewood, IL (US)

(73) Assignee: Caterpillar Inc., Deerfield, IL (US)

( * ) Notice: Subject to any disclaimer, the term of this patent is extended or adjusted under 35 U.S.C. 154(b) by 452 days.

(21) Appl. No.: 14/713,737

(22) Filed: May 15, 2015

(65) Prior Publication Data

US 2016/0333897 A1 Nov. 17, 2016

(51) Int. Cl.
*F15B 11/16* (2006.01)

(52) U.S. Cl.
CPC ... *F15B 11/162* (2013.01); *F15B 2211/30555* (2013.01); *F15B 2211/30575* (2013.01); *F15B 2211/3116* (2013.01); *F15B 2211/50563* (2013.01); *F15B 2211/528* (2013.01); *F15B 2211/605* (2013.01); *F15B 2211/6313* (2013.01); *F15B 2211/6346* (2013.01); *F15B 2211/7142* (2013.01); *F15B 2211/781* (2013.01)

(58) Field of Classification Search
CPC ..... F15B 11/162; F15B 2211/3116; F15B 2211/3111
USPC ..... 60/420, 468, 494; 91/516
See application file for complete search history.

(56) References Cited

U.S. PATENT DOCUMENTS

| | | | | |
|---|---|---|---|---|
| 2,892,311 | A * | 6/1959 | Van Gerpen | F15B 11/16 417/304 |
| 3,785,393 | A * | 1/1974 | Tanguy | B60T 13/148 137/110 |
| 3,952,509 | A * | 4/1976 | Coleman | E02F 9/2232 180/403 |
| 4,669,363 | A * | 6/1987 | Kreth | F15B 11/16 91/189 R |
| 5,493,950 | A * | 2/1996 | Kim | E02F 9/2221 60/426 |
| 6,658,843 | B1 | 12/2003 | Kauss | |
| 6,880,332 | B2 * | 4/2005 | Pfaff | F15B 11/006 60/422 |
| 7,921,878 | B2 | 4/2011 | Coolidge | |
| 8,893,490 | B2 | 11/2014 | Knussman et al. | |
| 2011/0146258 | A1 * | 6/2011 | Peters | F15B 11/162 60/422 |

* cited by examiner

*Primary Examiner* — Thomas E Lazo
(74) *Attorney, Agent, or Firm* — Baker Hostetler; William R. Tinker

(57) ABSTRACT

An IMV circuit includes a set of IMVs, an IMV resolver, an on/off bypass valve, and a bypass valve. The set of IMVs is fluidly coupled to an actuator to independently control a flow of a hydraulic fluid to the actuator. The IMV resolver is configured to receive a first pressure signal and a second pressure signal and output a third pressure signal. The on/off bypass valve is configured to control the flow of the hydraulic fluid to the set of IMVs in response to the third pressure signal. The bypass valve is fluidly coupled to a hydraulic fluid supply conduit downstream of an IMV circuit supply. The bypass valve is fluidly coupled to the IMV resolver and is configured to reduce the flow of hydraulic fluid through the hydraulic fluid supply conduit in response to an increase in pressure in the third pressure signal.

19 Claims, 6 Drawing Sheets

INDEPENDENT METERING VALVE PRIORITY IN OPEN CENTER HYDRAULIC SYSTEM

TECHNICAL FIELD

The present disclosure relates generally to hydraulic systems and, more particularly, to independent metering valve priority in a hydraulic system.

BACKGROUND

Hydraulic systems are known for converting fluid power, for example, pressurized flow, into mechanical power. Fluid power may be transferred from one or more hydraulic pumps through fluid conduits to one or more hydraulic actuators. Hydraulic actuators may include hydraulic motors that convert fluid power into shaft rotational power, hydraulic cylinders that convert fluid power into translational power, or other hydraulic actuators known in the art.

In an open-center hydraulic system, fluid discharged from an actuator is directed to a low-pressure reservoir, from which the pump draws fluid. Controlling an operation of a hydraulic actuator in a hydraulic circuit is conventionally accomplished using a single spool-type valve. The single spool valve has a series of metering slots which control flows of hydraulic fluid in the hydraulic circuit, including a flow from a pump to the hydraulic actuator and a flow from the hydraulic actuator to a tank. When the hydraulic actuator is a hydraulic cylinder, these flows are commonly referred to as pump-to-cylinder flow and cylinder-to-tank flow, respectively.

The metering slots may be machined into the stem of the spool valve. With this arrangement, slot timing and modulation are fixed. Thus, in order to modify the performance of a hydraulic circuit including such a spool valve, the stem may require additional machining. Furthermore, in order to add additional features to the performance of the hydraulic circuit, an entirely new stem may be required. In turn, adding features to or optimizing the performance of conventional hydraulic circuits may be expensive and time consuming.

Hydraulic systems with independent metering valves (IMVs) provide an operator with the ability to modify the performance of the hydraulic circuit without modifying hardware. In a hydraulic system with IMVs, each IMV includes four independently operable, electronically controlled metering valves to control flows within the hydraulic circuit. Two of the metering valves are disposed between the input port and the control ports. The other two metering valves are disposed between the output port and the control ports. Because each of the metering valves is controlled electronically, the performance of the hydraulic circuit can be modified by adjusting a control signal to one or more of the metering valves. IMVs operate in a closed-center system that is incompatible with conventional open-center systems. An example of this incompatibility is that priority in an open-center system is determined by proximity to the flow source of the hydraulic fluid while in closed-center systems, priority is a function of the programming in the control module.

U.S. Pat. No. 6,880,332 (hereinafter "the '332 patent"), titled "Method of Selecting a Hydraulic Metering Mode for a Function of a Velocity Based Control System," purports to describe a hydraulic system with an IMV in which the metering modes can be varied according to the task. However, while the '332 patent offers certain advantages over conventional spool-type valves, the hydraulic system of the '332 patent includes particular electrohydraulic (EH) control systems that are not present in conventional hydraulic systems. As a result, the hydraulic system of the '332 patent may be incompatible with conventional hydraulic systems incorporating spool-type valves.

Accordingly, there is a need for improved hydraulic systems to address the problems described above and/or problems posed by other conventional approaches.

SUMMARY

In one aspect, a hydraulic system includes a pump, a variable flow controller, an independent metering valve circuit, and a load-sense circuit. The pump is configured to generate a flow of a hydraulic fluid through a hydraulic fluid supply conduit. The variable flow controller is configured to control a flow rate of the pump in response to a first pressure signal. The independent metering valve circuit is fluidly coupled to the hydraulic fluid supply conduit via an independent metering valve circuit supply in fluid connection with the hydraulic fluid supply conduit. The independent metering valve circuit includes a first actuator, a set of independent metering valves, an independent metering valve resolver, an on/off bypass valve, and a bypass valve. The set of independent metering valves is fluidly coupled to the first actuator and configured to independently control the flow of the hydraulic fluid to the first actuator. A second pressure signal corresponds to a first induced pressure at a first side of the set of independent metering valves and a third pressure signal corresponds to a second induced pressure at a second side of the set of independent metering valves. The independent metering valve resolver is configured to receive the second pressure signal and the third pressure signal and output a fourth pressure signal. The on/off bypass valve is configured to control the flow of the hydraulic fluid to the set of independent metering valves in response to the fourth pressure signal. The bypass valve is fluidly coupled to the hydraulic fluid supply conduit downstream of the independent metering valve circuit supply. The bypass valve is fluidly coupled to the independent metering valve resolver and is configured to reduce the flow of hydraulic fluid through the hydraulic fluid supply conduit in response to an increase in pressure in the fourth pressure signal. The load-sense circuit is fluidly coupled to the bypass valve. The load-sense circuit includes a second actuator and a second control valve fluidly coupled to the second actuator and configured to control the flow of the hydraulic fluid to the second actuator. The second control valve has a signal port fluidly coupled to the variable flow controller and configured to generate the first pressure signal.

In another aspect, an independent metering valve circuit includes an actuator, a set of independent metering valves, an independent metering valve resolver, an on/off bypass valve, and a bypass valve. The set of independent metering valves is fluidly coupled to the actuator and configured to independently control a flow of a hydraulic fluid to the actuator. A first pressure signal corresponds to a first induced pressure at a first side of the set of independent metering valves and a second pressure signal corresponds to a second induced pressure at a second side of the set of independent metering valves. The independent metering valve resolver is configured to receive the first pressure signal and the second pressure signal and output a third pressure signal. The on/off bypass valve is configured to control the flow of the hydraulic fluid to the set of independent metering valves in response to the third pressure signal. The bypass valve is fluidly coupled to a hydraulic fluid supply conduit downstream of an independent metering valve circuit supply. The bypass valve is fluidly coupled to the independent metering valve resolver and is configured to reduce the flow of hydraulic fluid through the hydraulic fluid supply conduit in response to an increase in pressure in the third pressure signal.

In yet another aspect, the disclosure describes a method for integrating a priority independent metering valve circuit in a load-sense hydraulic system. In this method, a bypass valve is installed between a pump and a load-sense circuit of a load-sense hydraulic system. An independent metering valve circuit is installed upstream of the bypass valve. The independent metering valve circuit includes an actuator, a set of independent metering valves, an independent metering valve resolver, an on/off bypass valve. The set of independent metering valves is fluidly coupled to the actuator and configured to independently control a flow of a hydraulic fluid to the actuator. A first pressure signal corresponds to a first induced pressure at a first side of the set of independent metering valves and a second pressure signal corresponds to a second induced pressure at a second side of the set of independent metering valves. The independent metering valve resolver is configured to receive the first pressure signal and the second pressure signal and output a third pressure signal. The on/off bypass valve is configured to control the flow of the hydraulic fluid to the set of independent metering valves in response to the third pressure signal. The bypass valve is controlled to reduce the flow of hydraulic fluid through the hydraulic fluid supply conduit in response to an increase in pressure in the third pressure signal.

In yet another aspect, the disclosure describes a hydraulic system. The hydraulic system includes an open center hydraulic system, a closed center hydraulic system, a pump, a bypass valve and an on/off bypass valve. The pump is configured to generate a flow of a hydraulic fluid through the open center hydraulic system and the closed center hydraulic system. The bypass valve is disposed in fluid connection between the open center hydraulic system and the pump. The on/off bypass valve is configured to control the flow of the third pressure signal to the bypass valve in response to an electronic signal.

It will be understood that the disclosure is not limited in its application to the details of construction and to the arrangements of the components set forth in the following description or illustrated in the drawings. The disclosed device and method are capable of aspects in addition to those described and of being practiced and carried out in various ways. Also, it will be understood that the terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the various aspects. Therefore, the claims will be regarded as including such equivalent constructions insofar as they do not depart from the spirit and scope of the various aspects.

The drawings presented are intended solely for the purpose of illustration and therefore, are neither desired nor intended to limit the subject matter of the disclosure to any or all of the exact details of construction shown, except insofar as they may be deemed essential to the claims.

DETAILED DESCRIPTION

Figure 1:
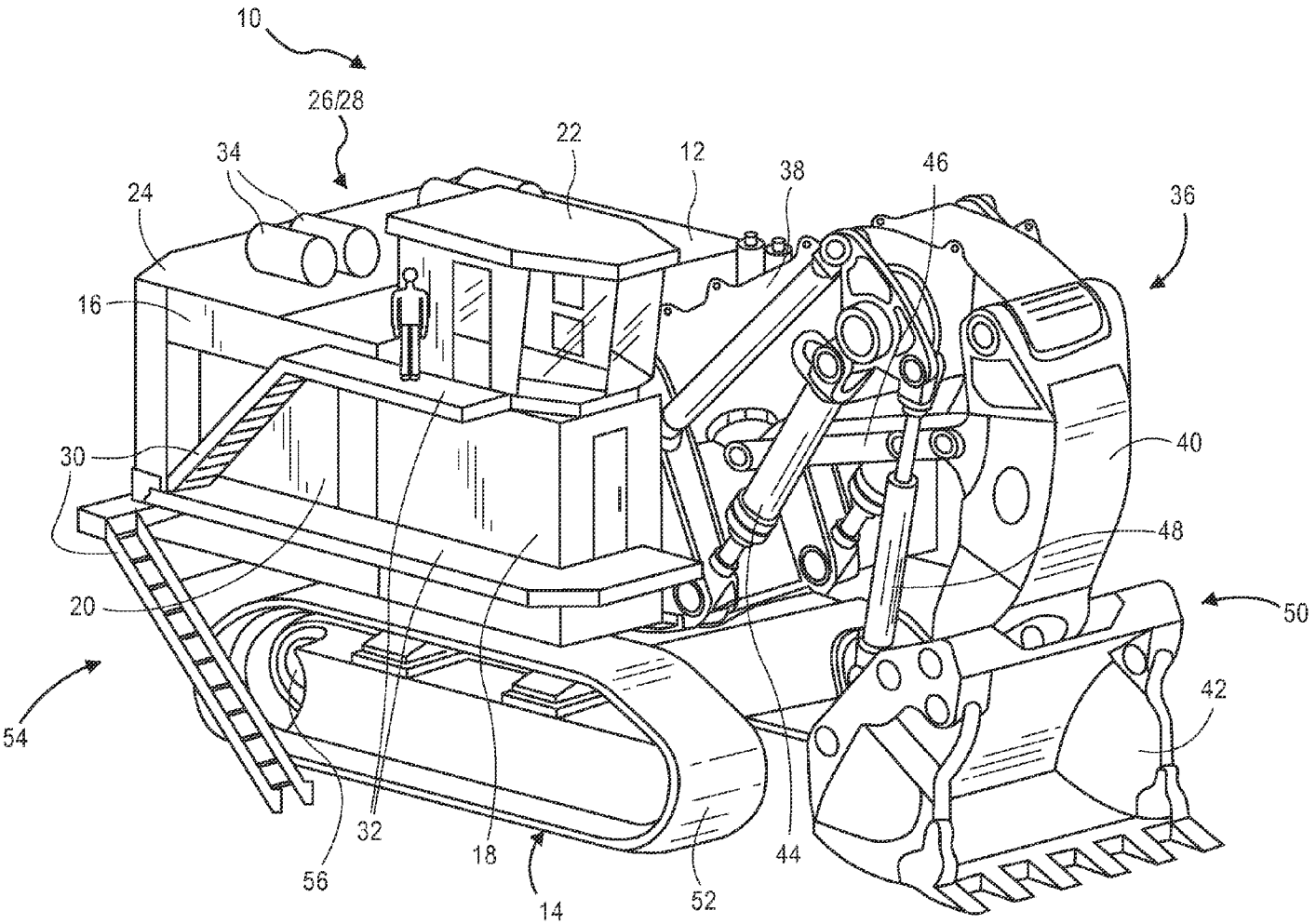
FIG. 1 illustrates an exemplary machine, according to an aspect of the disclosure.

FIG. 1 illustrates an exemplary machine 10 having various systems and components that cooperate to accomplish a task. The machine 10 may embody a fixed or mobile machine that performs some type of operation associated with an industry such as mining, construction, farming, transportation, or another industry known in the art. For example, the machine 10 may be an earth moving machine such as an excavator or a power shovel, a dozer, a loader, a backhoe, a motor grader, a dump truck, or another earth moving machine.

Referring to FIG. 1, the machine 10 may include heavy equipment in the form of a power shovel that includes a deck 12 moveable upon a drive system 14. The deck 12 further includes a powerhouse 16, an electronic compartment 18 (e.g., e-house), a hydraulic system 20, an operator cab or operator station 22, energy storage components 24, a power source 26, and hydraulic cooling systems 28. Various stairwells 30 and walkways 32 may be incorporated with the deck 12 for operator movement throughout the machine 10. Exhaust mufflers 34 are positioned on the deck 12 above the powerhouse 16 and to the rear of the operator station 22. Extending from the deck 12, the machine 10 further includes an articulated arm or implement system 36 including a boom 38 rotatably coupled to an arm 40 (e.g., a stick), which is rotatably coupled to a work tool 42.

According to an exemplary aspect of the disclosure, actuators (e.g., linear actuators) in the form of hydraulic cylinders, control the movements of the various components of the implement system 36. For example, a boom hydraulic cylinder 44 extends between the deck 12 and the boom 38 to control movement of the boom 38 relative to the deck 12. In addition, an arm hydraulic cylinder 46 extends between the boom 38 and the arm 40 to control movement of the arm 40 relative to the boom 38. A curl hydraulic cylinder 48 extends between the boom 38 and the work tool 42 to control movement of the work tool 42 relative to the arm 40. According to an exemplary aspect of the disclosure, the hydraulic cylinders 44, 46, 48 are double-acting cylinders, configured to receive hydraulic fluid on both ends of the respective pistons. Additional actuators (e.g., electric or hydraulic motors) may be used to propel the machine 10 via the drive system 14, and/or to rotate the deck 12 relative to the drive system 14.

Numerous different work tools 42 may be attached to the machine 10 and controlled by an operator. The work tool 42 may include any device used to perform a particular task such as, for example, a bucket (shown in FIG. 1), a fork arrangement, a blade, a shovel, a ripper, a dump bed, a broom, a snow blower, a propelling device, a cutting device, a grasping device, or any other task-performing device known in the art. Although the aspect illustrated in FIG. 1 shows the work tool 42 configured to pivot in the vertical direction relative to the body 23 and to swing in the horizontal direction about a pivot axis, it will be appreciated that the work tool 42 may alternatively or additionally rotate relative to the implement system 36, slide, open and close, or move in any other manner known in the art.

The drive system 14 may include one or more traction devices powered to propel the machine 10. As illustrated in FIG. 1, the drive system 14 may include a left track 50 located on one side of the machine 10, and a right track 52 located on an opposing side of the machine 10. The left track 50 may be driven by a left travel motor 54, and the right track 52 may be driven by a right travel motor 56. It is contemplated that the drive system 14 could alternatively include traction devices other than tracks, such as wheels, belts, or other known fraction devices. The machine 10 may be steered by generating a speed and/or rotational direction difference between the left travel motor 54 and the right travel motor 56, while straight travel may be effected by generating substantially equal output speeds and rotational directions of the left travel motor 54 and the right travel motor 56.

The power source 26 may include a combustion engine such as, for example, a reciprocating compression ignition engine, a reciprocating spark ignition engine, a combustion turbine, or another type of combustion engine known in the art. It is contemplated that the power source 26 may alternatively include a non-combustion source of power such as a fuel cell, a power storage device, or another power source known in the art. The power source 26 may produce a mechanical or electrical power output that may then be converted to hydraulic power for moving the actuators of the implement system 36.

The operator station 22 may include devices that receive input from an operator indicative of desired maneuvering. Specifically, the operator station 22 may include one or more operator interface devices 58 (shown in FIG. 4), for example a joystick, a steering wheel, or a pedal, that are located near an operator seat (not shown). Operator interface devices may initiate movement of the machine 10, for example travel and/or tool movement, by producing displacement signals that are indicative of desired machine 10 maneuvering. As an operator moves the operator interface device 58, the operator may affect a corresponding machine 10 movement in a desired direction, with a desired speed, and/or with a desired force.

Figure 2:
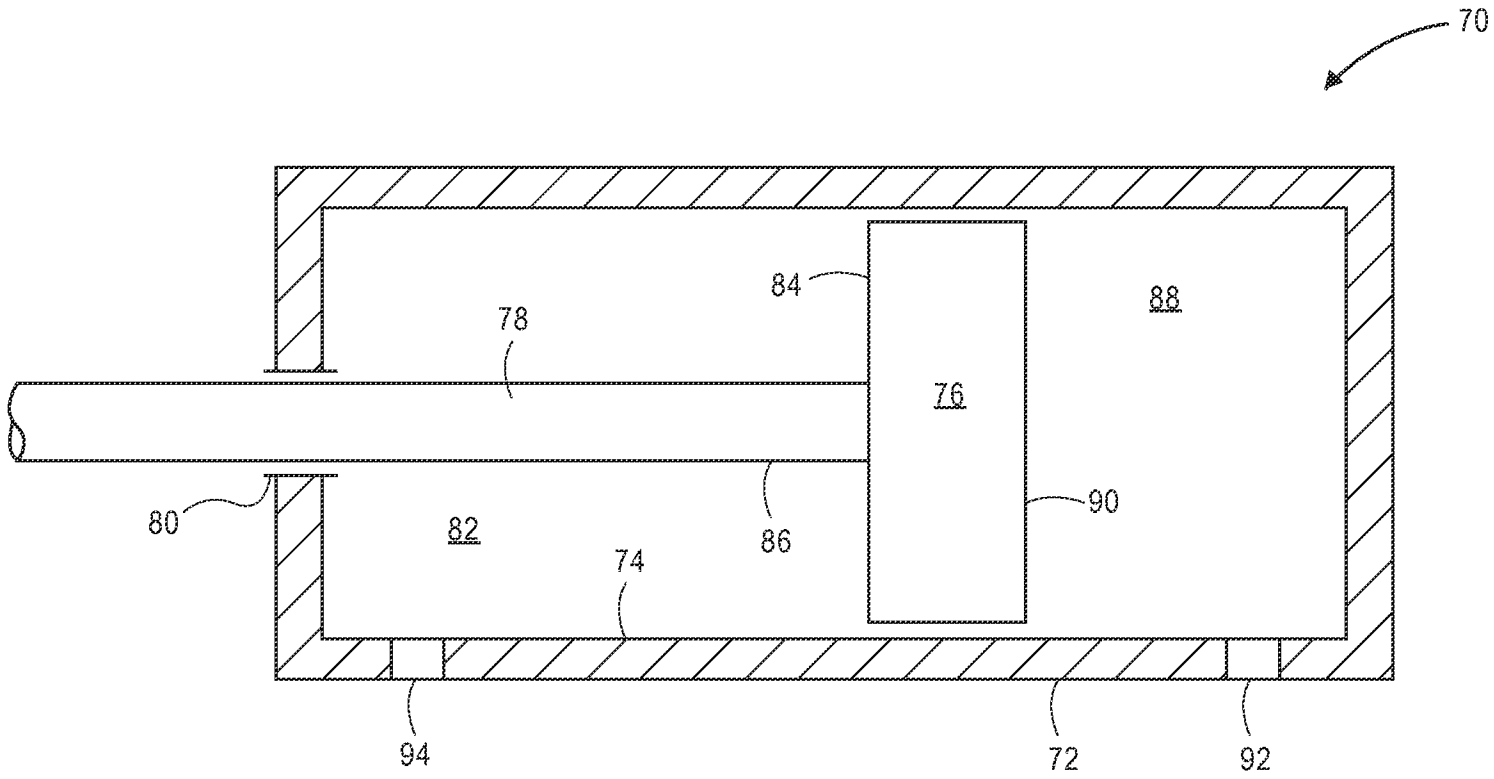
FIG. 2 shows a schematic view of a linear hydraulic cylinder, according to an aspect of the disclosure.

FIG. 2 shows a schematic view of a linear hydraulic cylinder 70, according to an aspect of the disclosure. The linear hydraulic cylinder 70 may include a tube 72 defining a cylinder bore 74 therein, and a piston assembly 76 disposed within the cylinder bore 74. A rod 78 is coupled to the piston assembly 76 and extends through the tube 72 at a seal 80. A rod-end chamber 82 is defined by a first face 84 of the piston, the cylinder bore 74, and a surface 86 of the rod 78. A head-end chamber 88 is defined by a second face 90 of the piston and the cylinder bore 74.

The head-end chamber 88 and the rod-end chamber 82 of the linear hydraulic cylinder 70 may be selectively supplied with pressurized fluid or drained of fluid via the head-end port 92 and the rod-end port 94, respectively, to cause piston assembly 76 to translate within tube 72, thereby changing the effective length of the actuator to move work tool 42, for example. A flow rate of fluid into and out of the head-end chamber 88 and the rod-end chamber 82 may relate to a translational velocity of the actuator, while a pressure differential and/or an area differential between the head-end chamber 88 and the rod-end chamber 82 may relate to a force imparted by the actuator on the work tool 42. It will be appreciated that any of the boom hydraulic cylinders 44, the arm hydraulic cylinder 46, or the curl hydraulic cylinder 48, shown in FIG. 1, may embody structural features of the linear hydraulic cylinder 70 illustrated in FIG. 2.

A rotary actuator may include first and second chambers located to either side of a fluid work-extracting mechanism such as an impeller, plunger, or series of pistons. When the first chamber is filled with pressurized fluid and the second chamber is simultaneously drained of fluid, the fluid work-extracting mechanism may be urged to rotate in a first direction by a pressure differential across the first and second chambers of the rotary actuator. Conversely, when the first chamber is drained of fluid and the second chamber is simultaneously filled with pressurized fluid, the fluid work-extracting mechanism may be urged to rotate in an opposite direction by the pressure differential. The flow rate of fluid into and out of the first and second chambers may be determined by a rotational velocity of the actuator, while a magnitude of the pressure differential across the pumping mechanism may determine an output torque. It will be appreciated that any of the hydraulic swing motor 60, the left travel motor 54, or the right travel motor 56, illustrated in FIG. 1, may embody the rotary actuator structure described above. Further, it will be appreciated that rotary actuators may have a fixed displacement or a variable displacement, as desired.

Figure 3:
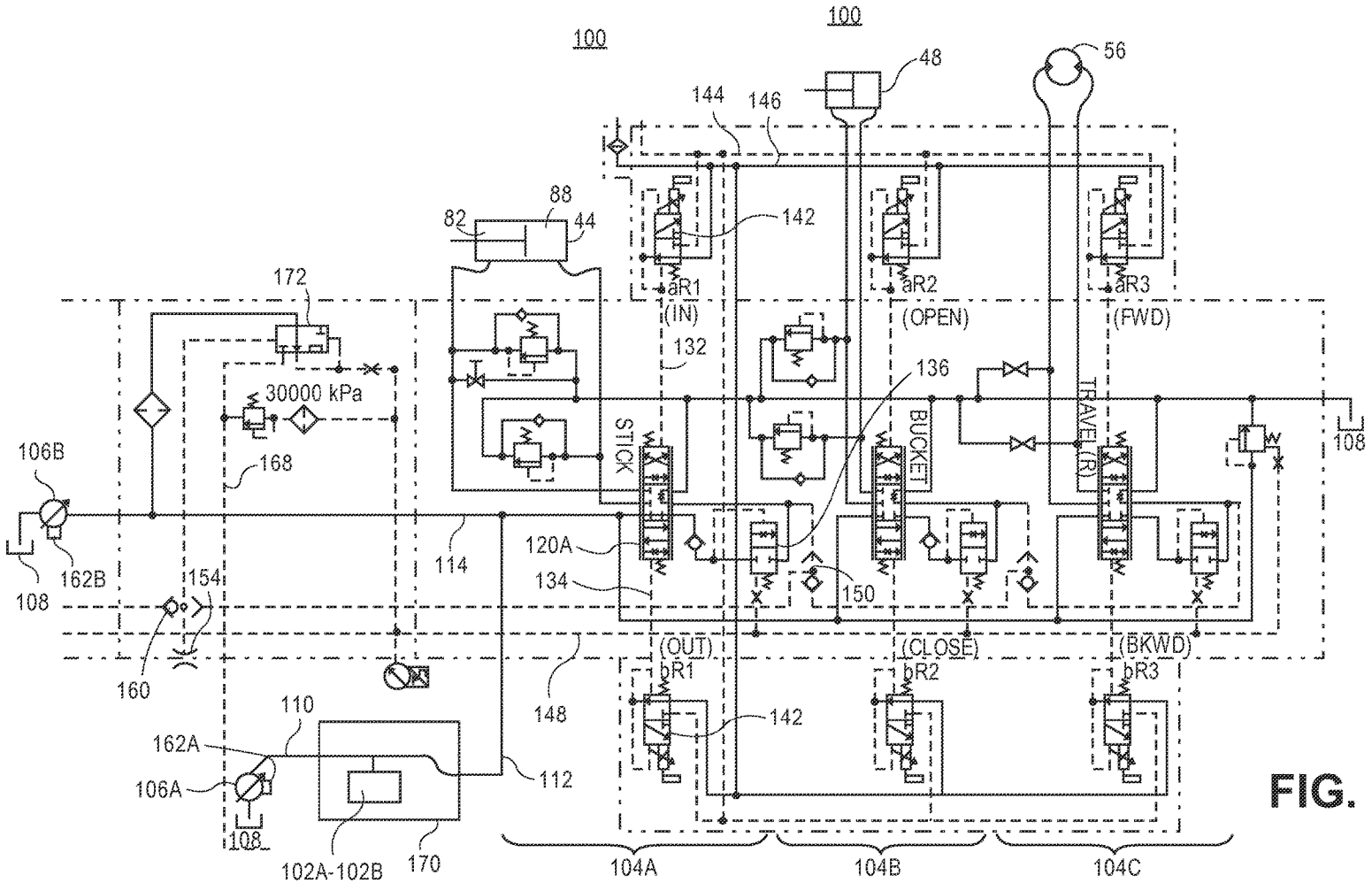
FIG. 3 shows a schematic view of a hydraulic system with load-sense that has been modified according to an aspect of the disclosure.

FIG. 3 shows a schematic view of a hydraulic system 100 with load-sense that has been modified according to an aspect of the disclosure. In general, the hydraulic system 100 has been modified to incorporate priority independent metering valve (IMV) circuits 102A and 102B, shown individually in FIGS. 4 and 5 and collectively referred to as the priority IMV circuit 102. For the purpose of this disclosure, the terms "prioritize" and variations thereof refer to a hydraulic circuit that has greater importance than other circuits in the hydraulic system, unless specified otherwise. The hydraulic system is configured to divert a greater portion of the hydraulic fluid flow to priority circuits in response to demand by the priority circuits that are configured to share one or more supplies of hydraulic pressure.

As shown in FIG. 3, the hydraulic system 100 includes a plurality of load-sense circuits 104A-C that each receives a flow of hydraulic fluid from one or more pumps 106A and 106B (collectively referred to as the pump 106) and returns the flow of hydraulic fluid to a tank 108. As is generally known, each load-sense circuit of the plurality of load-sense circuits 104A-C is utilized to perform an operation on the machine 10. For example, the load-sense circuit 104A may control the actuation of the boom hydraulic cylinder 44, the load-sense circuit 104B may control the actuation of the curl hydraulic cylinder 48, and the load-sense circuit 104C may control the actuation of the right travel motor 56. In addition, to the load-sense circuits 104A-104C, the hydraulic system 100 may include any suitable number of additional load-sense circuits for actuation of the various additional actuators of the machine 10. For example, the load-sense circuits 104A-104C may represent one wing, or about one half, of the hydraulic system 100. For the sake of brevity, the following description of load-sense circuit 104A will serve to describe the components and operations of the load-sense circuits 104B and 104C.

The load-sense circuit 104A includes a control valve 120A configured to control the flow of hydraulic fluid to and from the boom hydraulic cylinder 44 in response to control signals from the operator interface device 58 (shown in FIG. 4) and load-sense pressure signals 132 and 134. Optionally, the control valve 120A is further modulated by a post-compensation valve 136. To generate the load-sense pressure signals, the load-sense circuit 104A includes a pair of load-sense elements 140 and 142 that are configured to receive a load-sense signal pressure 144 and a supply of hydraulic fluid 146 and output the load-sense pressure signals 132 and 134 (respectively) based on the pressure of the load-sense signal pressure 144.

Optionally, the load-sense circuit 104A includes the post-compensation valve 136 configured to modulate the flow of hydraulic fluid through the control valve 120A in response to a load-sense pressure 148. If included, as is generally understood, the post-compensation valve 136 is configured to maintain a constant pressure drop across the control valve 120A regardless of the load induced pressure on the boom hydraulic cylinder 44.

The load-sense circuit 104A may further include a resolver 150 configured to receive the induced load pressure from the control valve 120A and the highest induced load pressure from the downstream circuits (load-sense circuits 104B and 104C) and output the highest load pressure to a system resolver 160. Prior to integrating the priority IMV circuit 102 into the hydraulic system 100, the system resolver 160 may have been configured to output the highest induced load pressure to one or more variable flow controllers 162A and 162B (collectively referred to as the variable flow controller 162). The variable flow controller 162 is a pressure responsive controller configured to control the output of the pump 106. In a particular example, the variable flow controller 162 is configured to de-stroke or otherwise control the displacement of the pump 106 via a swashplate actuator. However, the variable flow controller 162 may include any suitable controller capable of modulating the output of the pump 106. In this manner, the pump 106 is operable to supply sufficient flow for the highest induced pressure circuit of the load-sense circuits 104A-104C.

To integrate the priority IMV circuit 102 into the hydraulic system 100, a priority circuit 170 is added to the hydraulic system 100. The priority circuit 170 is disposed in fluid connection between the pump 106A and the load-sense circuits 104A-104C. For example, the priority circuit 170 may be fluidly coupled to the pump 106A via a hydraulic fluid supply conduit 110 and the priority circuit 170 may be fluidly coupled to a common rail conduit 114 via a hydraulic fluid supply conduit 112. In turn, the common rail conduit 114 may be fluidly coupled to the pump 106B and the load-sense circuits 104A-104C.

Figure 4:
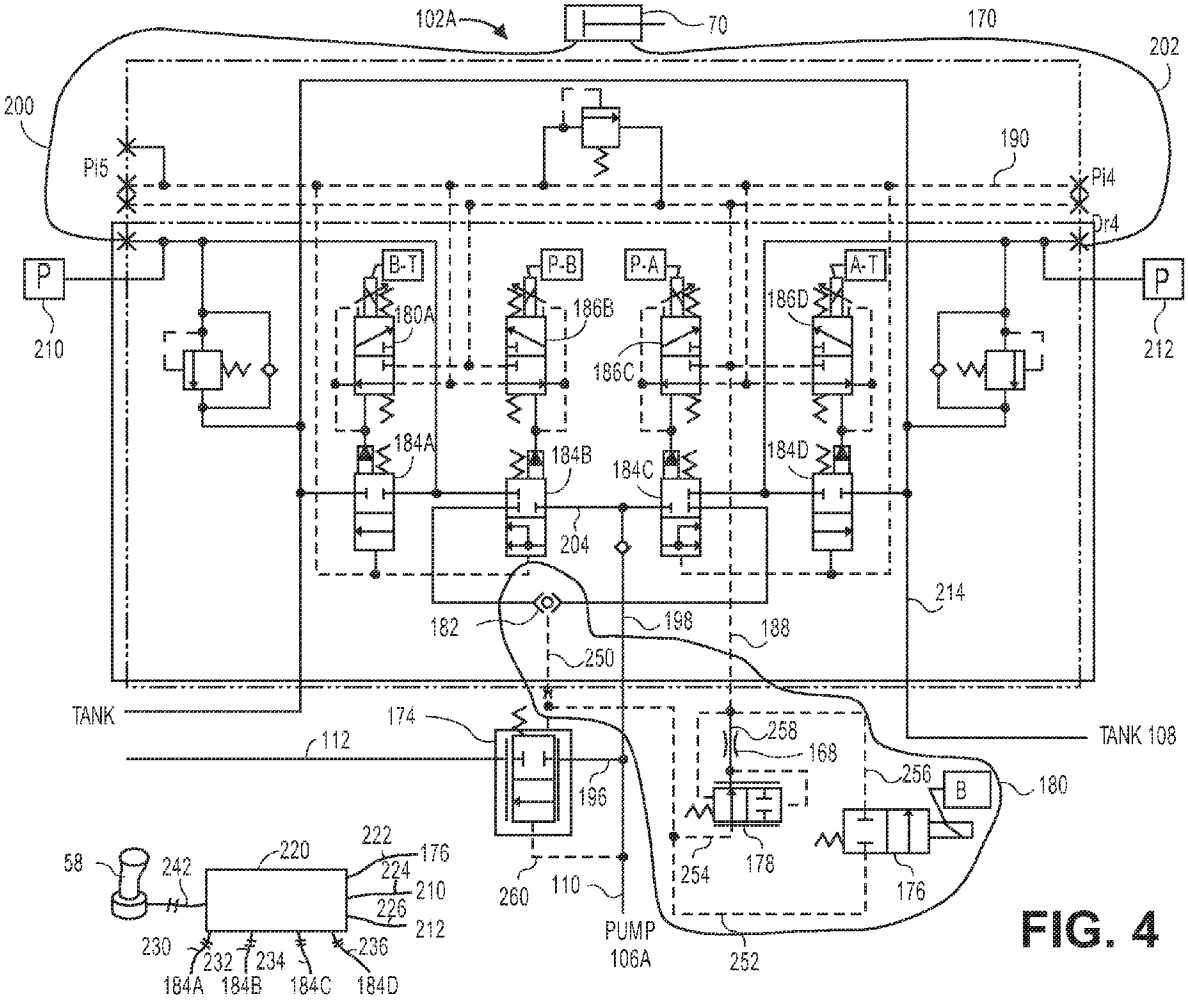
FIG. 4 shows a schematic view of an independent metering valve (IMV) circuit, according to an aspect of the disclosure.

FIG. 4 shows a schematic view of the priority IMV circuit 102A, according to an aspect of the disclosure. In this example, the priority IMV circuit 102A is suitable for providing a priority IMV circuit in the load-sense hydraulic system 100 as shown in FIG. 3. As shown in FIG. 4, the priority IMV circuit 102A can include one or more of a bypass valve 174, an on/off bypass valve 176, an IMV signal conditioner 178, an IMV resolver 182, a set of four, operator-controlled, independent metering valves 184A-184D, a set of four, pilot-operated, proportional valves 186A-186D, and the linear hydraulic cylinder 70. Together, the on/off bypass valve 176, the IMV signal conditioner 178, and the IMV resolver 182 are configured to provide a conditioned load-sense circuit 180 to provide conditioned load-sense pressure signals to the proportional valves 186A-186D. A pilot supply conduit 188 provides a pilot signal pressure to the proportional valves 186A-186D from the conditioned load-sense circuit 180. A pilot drain conduit 190 conveys the flow of pilot signal oil away from the priority IMV circuit 102A.

The flow of hydraulic fluid is supplied via the supply conduit 110 for supplying a hydraulic fluid within the priority IMV circuit 102A and the supply conduit 110 is connected to the bypass valve 174 via a supply conduit 196. As shown in FIG. 4, the priority IMV circuit 102A is fluidly connected to the pump 106A upstream of the bypass valve 174. By controlling the bypass valve 174 to reduce or stop the flow of hydraulic fluid to the hydraulic fluid supply conduit 112, the priority IMV circuit 102A may receive a greater portion of the flow of hydraulic fluid from the pump 102A than another load-sense and/or IMV circuit in the hydraulic system 100. A supply conduit 198 connects the supply conduit 110 to a supply conduit 204 that, in turn, is connected to the pair of electronically-actuated independent metering valves 184B and 184C.

The independent metering valves 184A and 184B are connected by a first actuator conduit or head-end actuator conduit 200 to the bi-directional linear hydraulic cylinder 70. The linear hydraulic cylinder 70 is also connected to the independent metering valves 184C and 184D by a second actuator conduit or rod-end actuator conduit 202. A pressure sensor 210 is shown connected to the head-end actuator conduit 200 to sense the pressure in the head-end actuator conduit 200. Another pressure sensor 212 is connected to the rod-end actuator conduit 202 for sensing the pressure in the rod-end actuator conduit 202. Another conduit such as an output conduit 214 connects the independent metering valves 184A and 184D to the tank 108.

The priority IMV circuit 102A further includes a flow control module 220, such as a microprocessor, which is used to control operation of the priority IMV circuit 102A. The flow control module 220 may be connected to the pressure sensors 210 and 212 by electrical leads 224 and 226, respectively. The flow control module 220 is capable of receiving signals from the pressure sensors 210 and 212 over the electrical leads 224 and 226 to determine the pressure in the head-end actuator conduit 200 and the rod-end actuator conduit 202.

The independent metering valves 184A, 184B, 184C, and 184D are connected to the flow control module 220 via electrical connections 230, 232, 234, and 236, respectively. The flow control module 220 is capable of sending command signals over the electrical connections 230, 232, 234, and 236 to control operation of the independent metering valves 184A, 184B, 184C, and 184D. The flow control module 220 also includes an operator interface device 58 operatively coupled to the flow control module 220 by a wire 242 or other signal conductor, for example. The operator interface device 58 may include such devices as an operator lever, pedal, joystick, keypad, or a keyboard for inputting information such as the speed required of the linear hydraulic cylinder 70. The operator interface device 58 is also capable of providing an input signal or command to the flow control module 220 over the wire 242. Typically, input signal from the operator interface device 58 is a velocity command signal. That is, the operator in the operator station 22 manipulates the operator interface device 58 to achieve a target velocity of a selected implement.

The flow control module 220 is capable of receiving signals from the operator interface device 58 and pressure sensors 210 and 212 and/or other suitable sensors. Based upon these signals the flow control module 220 is configured to control operation of the independent metering valves 184A, 184B, 184C, and 184D and, optionally, the pump 106.

In some particular examples of control sequences, the independent metering valves 184B and 184D may be initially opened and the independent metering valves 184A and 184C are initially closed. Extension of the linear hydraulic cylinder 70 occurs when the independent metering valves 184B and 184D are opened and the independent metering valves 184A and 184C are closed.

Depending upon the pressures sensed by the pressure sensors 210 and 212, the independent metering valve 184C may be opened to restrict the flow of hydraulic fluid, for example, from the linear hydraulic cylinder 70, to brake or slow down the linear hydraulic cylinder 70. Additionally, the independent metering valve 184A may be opened to divert the flow of hydraulic fluid back to the tank 108. The output conduit 214 allows hydraulic fluid to flow from the independent metering valve 184A through the output conduit 214 into the tank 108 to be used again by the pump 106. Accordingly, a regenerative supply or source of hydraulic fluid for the pump 106 is provided, and in this mode of operation the priority IMV circuit 102A is regenerative. These and other suitable control sequences may be controlled by the flow control module 220.

In general, the conditioned load-sense circuit 180 is configured to provide pressure signals to modulate the proportional valves 186A-186D as well as the operation of the bypass valve 174. In this regard, the IMV resolver 182 is configured to resolve the highest induced pressure across the priority IMV circuit 102A and output a pressure signal to the bypass valve 174 via a pilot signal conduit 250. The pressure signal from the IMV resolver 182 is then conveyed to the on/off bypass valve 176 via a pilot signal conduit 252. In parallel, the pressure signal from the IMV resolver 182 is conveyed to the optional IMV signal conditioner 178 via a pilot signal conduit 254. If included, the IMV signal conditioner 178 may include an associated bleed orifice 168 configured to allow a predetermined amount of hydraulic pressure to bleed off from the pilot signal conduit 250 when the IMV signal conditioner 178 is open. By adjusting the bleed orifice 168 and predetermined amount of hydraulic pressure flowing therethrough, the sensitivity of the bypass valve 174 may be modulated.

The on/off bypass valve 176 is configured to modulate the received pressure signal in response to electronic signals via the flow control module 220. In one example, the on/off bypass valve 176 is movable between a first position or open position (shown in FIG. 6) to a second position or closed position (shown in FIG. 4). In response to the on/off bypass valve 176 being in the closed position, pressure in the pilot signal conduit 250 increases to turn off the bypass valve 174 (shown in FIG. 4) and giving priority to the priority IMV circuit 102A. If included, the IMV signal conditioner 178 is opened in response to the on/off bypass valve 176 being closed and the pressure in the pilot signal conduit 256 dropping.

Figure 6:
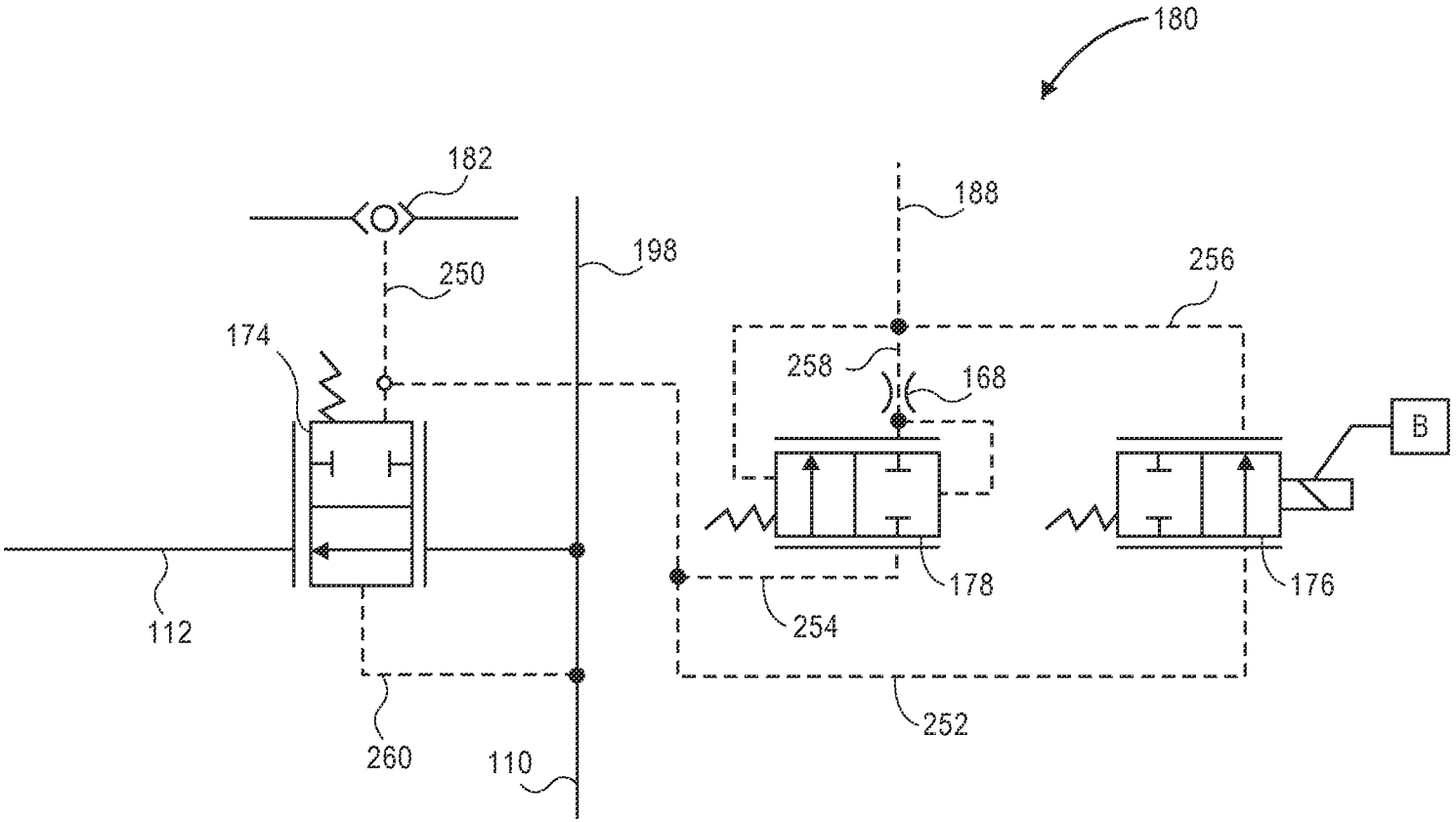
FIG. 6 shows a schematic view of a bypass valve and conditioned load-sense circuit in an open position, according to an aspect of the disclosure.

Conversely, as shown in FIG. 6, in response to the on/off bypass valve 176 being in the open position, pressure in the pilot signal conduit 250 is decreased allowing the pressure in a pilot signal conduit 260 to open the bypass valve 174 which allows pump flow be shared with other functions. The on/off bypass valve 176 receives electronic signals via the flow control module 220 to maintain its position at the second position Once there is an operator command to activate the actuator of the IMV circuit, current to the on/off bypass valve 176 is shut off, thereby allowing the on/off bypass valve 176 to move to the first position (shown in FIG. 4) because of the spring. A pressure signal from the on/off bypass valve 176 is conveyed via a pilot signal conduit 256 and combined with a pressure signal from the IMV signal conditioner 178 that is conveyed via a pilot signal conduit 258. This conditioned pressure signal is then conveyed to modulate the proportional valves 186A-186D via the pilot supply conduit 188 (shown in FIG. 4).

Figure 5:
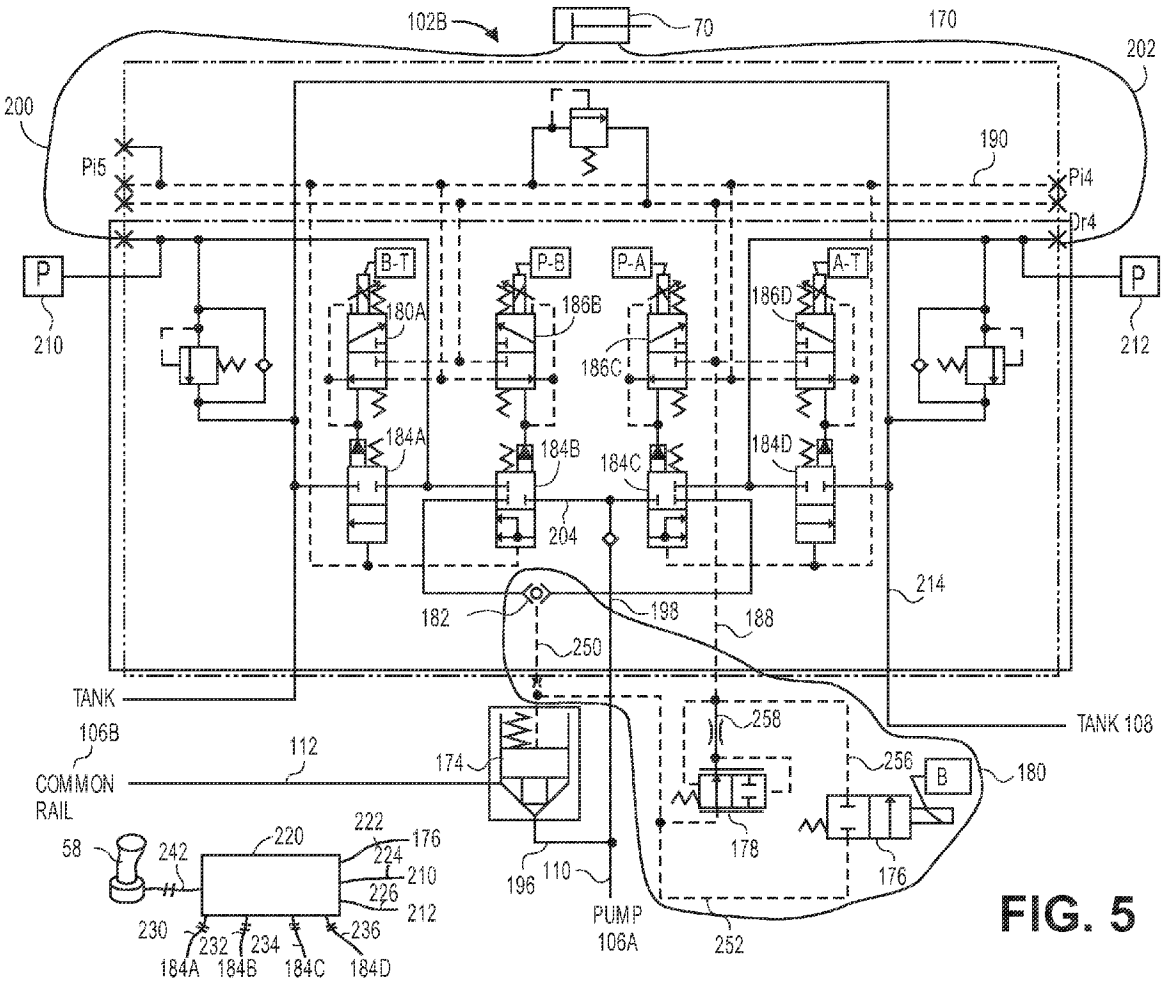
FIG. 5 shows a schematic view of an IMV circuit, according to an aspect of the disclosure.

FIG. 5 shows a schematic view of the priority IMV circuit 102B, according to an aspect of the disclosure. The priority IMV circuit 102B is similar to the priority IMV circuit 102A shown in FIG. 4 in many respects, and thus, for the sake of brevity, those elements described with reference to FIG. 4 will not be described again. As shown in FIG. 5, the bypass valve 174 of the priority IMV circuit 102B is a poppet-type valve. The bypass valve 174 is configured to provide two-way flow that is biased toward the priority IMV circuit 102B in response to the pressure signal from the IMV resolver 182. The amount of bias may be varied depending on the area ratio of the bypass valve 174. In this manner, the priority IMV circuit 102B can be configured to flowshare with the hydraulic system 100.

INDUSTRIAL APPLICABILITY

The present disclosure may be applicable to any machine in which an independent metering valve (IMV) circuit is combined in a flowsharing arrangement with a load-sense hydraulic system. Aspects of the disclosed hydraulic system and method may promote increased functionality, operationally flexibility, performance, and energy efficiency of hydraulic systems.

According to an aspect of the disclosure, with reference to FIGS. 1 and 3, the machine 10 is a power shovel or an excavator, and the load-sense circuits 104A-104C control the movement of the various components of the machine 10. Adding an IMV circuit to the machine 10 may benefit the machine 10 in terms of improved hydraulic flow utilization, regenerative breaking, improved velocity control, reduced overspeed, and the like.

In order to add the priority IMV circuit 102 into the hydraulic system 100, the priority IMV circuit 102 is fluidly coupled between the pump 102A and the load-sense circuits 104A-104C and the bypass valve 174 is fluidly coupled between the priority IMV circuit 102 and the load-sense circuits 104A-104C. In such a configuration if the priority IMV circuit 102 generate an induced load, the bypass valve 174 is configured to reduce the priority IMV circuit 102. During operation of machine 10, shown in FIG. 1, an operator located within operator station 22 may command a particular motion of the work tool 42 in a desired direction and at a desired velocity by way of the operator interface device 58.

Each of the priority IMV circuits 102A to 102B provide a non-limiting example of how the capabilities of a conventional load-sense hydraulic system can be improved. In general, closed center circuits cannot flowshare in a conventional open center system. However, the closed center IMV circuit offers control improvements that are unavailable in open center systems. In order to integrate the priority circuit 170 (which is a closed center IMV circuit) into the hydraulic system 100 (which is an open center load-sense circuit shown in FIG. 3), the bypass valve 174 is disposed in fluid communication between the pump 106A and the rest of the hydraulic system 100. The conditioned load-sense circuit 180 is used to modulate the bypass valve 174. For example, the priority IMV circuit 102A illustrates a priority IMV circuit in the hydraulic system 100 in which the pump 106A supplies sufficient flow of hydraulic fluid for the priority IMV circuit 102A. In this circuit, commands at the operator interface device 58 to move the linear hydraulic cylinder 70 are translated into electronic signals by the flow control module 220. These signals are used to de-energize the on/off bypass valve 176 which opens the on/off bypass valve 176 via bias spring pressure which then closes the bypass valve 174 via pilot pressure from the pilot signal conduit 250 and shunts hydraulic pressure to the IMV circuit 102A. It must be noted that while one IMV circuit 102A is shown in the priority circuit 170 in FIG. 4, any suitable number of additional IMV circuits may be provided hydraulic fluid flow via the bypass valve 174 and the conditioned load-sense circuit 180 to modulate the bypass valve 174. For example, 2, 3, or more additional IMV circuits may be added to the priority circuit 170 as long as the hydraulic fluid supply is adequate.

In the example shown in FIG. 5, the priority IMV circuit 102B illustrates an example in which flowsharing of the pump 106B may supplement the flow of hydraulic fluid from the pump 106A to the priority IMV circuit 102B. That is, it is an advantage that if the pressure drops sufficiently at the supply conduit 110, the pressure at supply conduit 112 may open the poppet-style bypass valve 174 sufficiently to allow hydraulic fluid to flow back through the bypass valve 174 and into the priority circuit 170. The priority circuit 170 of FIG. 5 is similar to the priority circuit 170 of FIG. 4 in that additional IMV circuits may be fluidly coupled within the priority circuit 170.

Collectively, by including the appropriate priority IMV circuit 102A-B, shown in FIGS. 4-5, to the hydraulic system 100, the operator is provided with improved functionality of the implement controlled by the priority IMV circuit 102. Examples of improved functionality gained by the addition of the priority IMV circuit include improved regenerative operations of the implement, improved responsiveness and the ability to modify the performance of the priority IMV circuit as compared to the static performance response of conventional spool valves. Accordingly, this improved functionality can be provided while maintaining the existing pumps, pressure accumulators, and the like. In this manner, the cost outlay for the improved functionality of the priority IMV circuit 102 may be minimized. In addition some hydraulic circuits may benefit more from having a priority IMV circuit than other hydraulic circuits. Additionally, some hydraulic systems may benefit from the capability to flowshare with the priority IMV circuit more than other systems. As such the priority IMV circuits 102A to 102B provide solutions to a variety of hydraulic implementations.

According to an aspect of the disclosure, the priority circuit 170 is included in a kit to be added to a machine 10. Further, such a kit may also include the priority IMV circuit 102, corresponding control structures or software that compose, at least in part, the flow control module 220. According to another aspect of the disclosure, a kit including the priority circuit 170, the priority IMV circuit 102, corresponding control structures or software that compose, at least in part, the flow control module 220, or combinations thereof, are installed on a machine 10.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Throughout the disclosure, like reference numbers refer to similar elements herein, unless otherwise specified.

I claim:

1. A hydraulic system, comprising:

a pump configured to generate a flow of a hydraulic fluid through a hydraulic fluid supply conduit;

a variable flow controller configured to control a flow rate of the pump in response to a first pressure signal;

an independent metering valve circuit fluidly coupled to the hydraulic fluid supply conduit via an independent metering valve circuit supply in fluid connection with the hydraulic fluid supply conduit, the independent metering valve circuit including:

a first actuator;

a set of independent metering valves fluidly coupled to the first actuator and configured to independently control the flow of the hydraulic fluid to the first actuator, wherein a second pressure signal corresponds to a first induced pressure at a first side of the set of independent metering valves and a third pressure signal corresponds to a second induced pressure at a second side of the set of independent metering valves;

an independent metering valve resolver configured to receive the second pressure signal and the third pressure signal and output a fourth pressure signal;

an on/off bypass valve configured to control the flow of the hydraulic fluid to the set of independent metering valves in response to the fourth pressure signal; and a bypass valve fluidly coupled to the hydraulic fluid supply conduit downstream of the independent metering valve circuit supply, the bypass valve being fluidly coupled to the independent metering valve resolver and being configured to reduce the flow of hydraulic fluid through the hydraulic fluid supply conduit in response to an increase in pressure in the fourth pressure signal; and a load-sense circuit fluidly coupled to the bypass valve, the load-sense circuit including:

a second actuator; and a second control valve fluidly coupled to the second actuator and configured to control the flow of the hydraulic fluid to the second actuator, the second control valve having a signal port fluidly coupled to the variable flow controller and configured to generate the first pressure signal.

2. The hydraulic system according to claim 1, wherein the bypass valve is a spool-type bypass valve.

3. The hydraulic system according to claim 1, wherein the bypass valve is a poppet-type bypass valve.

4. The hydraulic system according to claim 3, further comprising:

a second pump in fluid connection with the hydraulic fluid supply conduit downstream of the bypass valve, wherein the bypass valve is configured to selectively provide a flow path from the second pump to the independent metering valve circuit.

5. The hydraulic system according to claim 1, further comprising:

a set of pilot-operated proportional valves including a pilot-operated proportional valve for each independent metering valve of the set of independent metering valves, the set of pilot-operated proportional valves being configured to modulate the set of independent metering valves in response to the fourth pressure signal.

6. The hydraulic system according to claim 5, further comprising:

a signal conditioning element disposed in parallel flow with the on/off bypass valve, the signal conditioning element being configured to condition the fourth pressure signal.

7. The hydraulic system according to claim 1, further comprising a set of pressure sensors in communication with the variable flow controller, the set of pressure sensors being configured to sense a pressure of the hydraulic fluid at a first side of the first actuator and a second side of the first actuator.

8. The hydraulic system according to claim 1, further comprising a plurality of load-sense circuits fluidly coupled to the pump.

9. The hydraulic system according to claim 1, further comprising a plurality of independent metering valve circuits fluidly coupled to the pump via the independent metering valve circuit supply.

10. An independent metering valve circuit, comprising:

an actuator;

a set of independent metering valves fluidly coupled to the actuator and configured to independently control a flow of a hydraulic fluid to the actuator, wherein a first pressure signal corresponds to a first induced pressure at a first side of the set of independent metering valves and a second pressure signal corresponds to a second induced pressure at a second side of the set of independent metering valves;

an independent metering valve resolver configured to receive the first pressure signal and the second pressure signal and output a third pressure signal;

a bypass valve fluidly coupled to a hydraulic fluid supply conduit downstream of an independent metering valve circuit supply, the bypass valve being fluidly coupled to the independent metering valve resolver and being configured to reduce the flow of hydraulic fluid through the hydraulic fluid supply conduit in response to an increase in pressure in the third pressure signal; and an on/off bypass valve configured to control the flow of the third pressure signal to the bypass valve in response to an electronic signal.

11. The independent metering valve circuit according to claim 10, wherein the bypass valve is a spool-type bypass valve.

12. The independent metering valve circuit according to claim 10, wherein the bypass valve is a poppet-type bypass valve.

13. The independent metering valve circuit according to claim 12, wherein the bypass valve is configured to provide a flow path from a pump disposed downstream of the bypass valve to the independent metering valve circuit.

14. The independent metering valve circuit according to claim 10, further comprising:

a set of pilot-operated proportional valves including a pilot-operated proportional valve for each independent metering valve of the set of independent metering valves, the set of pilot-operated proportional valves being configured to modulate the set of independent metering valves in response to the third pressure signal.

15. The independent metering valve circuit according to claim 14, further comprising:

a signal conditioning element disposed in parallel flow with the on/off bypass valve, the signal conditioning element being configured to condition the third pressure signal.

16. The independent metering valve circuit according to claim 10, further comprising:

a pump configured to generate a flow of a hydraulic fluid through the independent metering valve circuit via a hydraulic fluid supply conduit;

a variable flow controller configured to control a flow rate of the pump in response to a first pressure signal; and a set of pressure sensors in communication with the controller, the set of pressure sensors being configured to sense a pressure of the hydraulic fluid at a first side of the first actuator and at a second side of the first actuator.

17. The independent metering valve circuit according to claim 10, further comprising a plurality of load-sense circuits fluidly coupled to the first pump.

18. The independent metering valve circuit according to claim 10, further comprising a plurality of independent metering valve circuits fluidly coupled to the first pump via the independent metering valve circuit supply.

19. A hydraulic system, comprising:

an open center hydraulic system;

a closed center hydraulic system;

a pump configured to generate a flow of a hydraulic fluid through the open center hydraulic system and the closed center hydraulic system;

a bypass valve disposed in fluid connection between the open center hydraulic system and the pump;

an on/off bypass valve configured to control the flow of a pressure signal to the bypass valve in response to an electronic signal; and a variable flow controller configured to generate the electronic signal.

* * * * *